US010166774B2

(12) United States Patent
Yoshida

(10) Patent No.: US 10,166,774 B2
(45) Date of Patent: Jan. 1, 2019

(54) LIQUID DISCHARGE HEAD, LIQUID DISCHARGE DEVICE, AND LIQUID DISCHARGE APPARATUS

(71) Applicant: Takahiro Yoshida, Ibaraki (JP)

(72) Inventor: Takahiro Yoshida, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 11 days.

(21) Appl. No.: 15/434,479

(22) Filed: Feb. 16, 2017

(65) Prior Publication Data

US 2017/0239949 A1 Aug. 24, 2017

(30) Foreign Application Priority Data

Feb. 18, 2016 (JP) ..... 2016-029237

(51) Int. Cl.
*B41J 2/14* (2006.01)

(52) U.S. Cl.
CPC ..... *B41J 2/14233* (2013.01); *B41J 2/14274* (2013.01); *B41J 2002/14419* (2013.01); *B41J 2202/12* (2013.01)

(58) Field of Classification Search
CPC ..... B41J 2/14201; B41J 2/14233; B41J 2/14274; B41J 2/14282; B41J 2/14298; B41J 2/14; B41J 2002/14225; B41J 2002/1425; B41J 2002/14266; B41J 2002/14306
See application file for complete search history.

(56) References Cited

U.S. PATENT DOCUMENTS

2009/0147034 A1 6/2009 Yoshida
2009/0289975 A1 11/2009 Yoshida
2013/0307911 A1* 11/2013 Hayashi ..... B41J 2/17563 347/93
2015/0062255 A1 3/2015 Sasaki
2015/0246536 A1 9/2015 Yoshida
(Continued)

FOREIGN PATENT DOCUMENTS

JP 2012-143948 8/2012
JP 2014-144561 8/2014
JP 2015-071289 4/2015

*Primary Examiner* — Kristal Feggins
(74) *Attorney, Agent, or Firm* — Cooper & Dunham LLP

(57) ABSTRACT

A liquid discharge head includes a plurality of nozzles, a plurality of individual liquid chambers, a circulation channel, a circulation common liquid chamber, a common liquid chamber, and a vibration damping member. The plurality of nozzles discharges liquid. The plurality of individual liquid chambers is communicated with the plurality of nozzles. The circulation channel is communicated with the plurality of individual liquid chambers. The circulation common liquid chamber is communicated with the circulation channel. The common liquid chamber supplies the liquid to the plurality of individual liquid chambers. The common liquid chamber includes a first portion disposed side by side with the circulation common liquid chamber in an in-plane direction and a second portion having a width greater than a width of the first portion in the in-plane direction. The vibration damping member is recoverably deformable and constitutes a wall surface of the second portion of the common liquid chamber.

15 Claims, 8 Drawing Sheets

(56) References Cited

U.S. PATENT DOCUMENTS

| | | | | |
|---|---|---|---|---|
| 2016/0082728 | A1 | 3/2016 | Kohda et al. | |
| 2016/0096369 | A1 | 4/2016 | Shimizu et al. | |
| 2016/0185113 | A1* | 6/2016 | Yoshida | B41J 2/14233 347/47 |

* cited by examiner

LIQUID DISCHARGE HEAD, LIQUID DISCHARGE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2016-029237 filed on Feb. 18, 2016 in the Japan Patent Office, the entire disclosure of which is hereby incorporated by reference herein.

BACKGROUND

Technical Field

Aspects of the present disclosure relate to a liquid discharge head, a liquid discharge device, and a liquid discharge apparatus.

Related Art

As a liquid discharge head (droplet discharge head) to discharge liquid, for example, a circulation-type head is known that circulates liquid in a plurality of individual liquid chambers.

SUMMARY

In an aspect of the present disclosure, there is provided a liquid discharge head that includes a plurality of nozzles, a plurality of individual liquid chambers, a circulation channel, a circulation common liquid chamber, a common liquid chamber, and a vibration damping member. The plurality of nozzles discharges liquid. The plurality of individual liquid chambers is communicated with the plurality of nozzles. The circulation channel is communicated with the plurality of individual liquid chambers. The circulation common liquid chamber is communicated with the circulation channel. The common liquid chamber supplies the liquid to the plurality of individual liquid chambers. The common liquid chamber includes a first portion and a second portion. The first portion is disposed side by side with the circulation common liquid chamber in an in-plane direction. The second portion has a width greater than a width of the first portion in the in-plane direction. The vibration damping member is recoverably deformable and constitutes a wall surface of the second portion of the common liquid chamber.

In another aspect of the present disclosure, there is provided a liquid discharge device that includes the liquid discharge head to discharge liquid.

In still another aspect of the present disclosure, there is provided a liquid discharge apparatus that includes the liquid discharge device to discharge the liquid.

In still yet another aspect of the present disclosure, there is provided a liquid discharge apparatus including the liquid discharge head to discharge the liquid.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
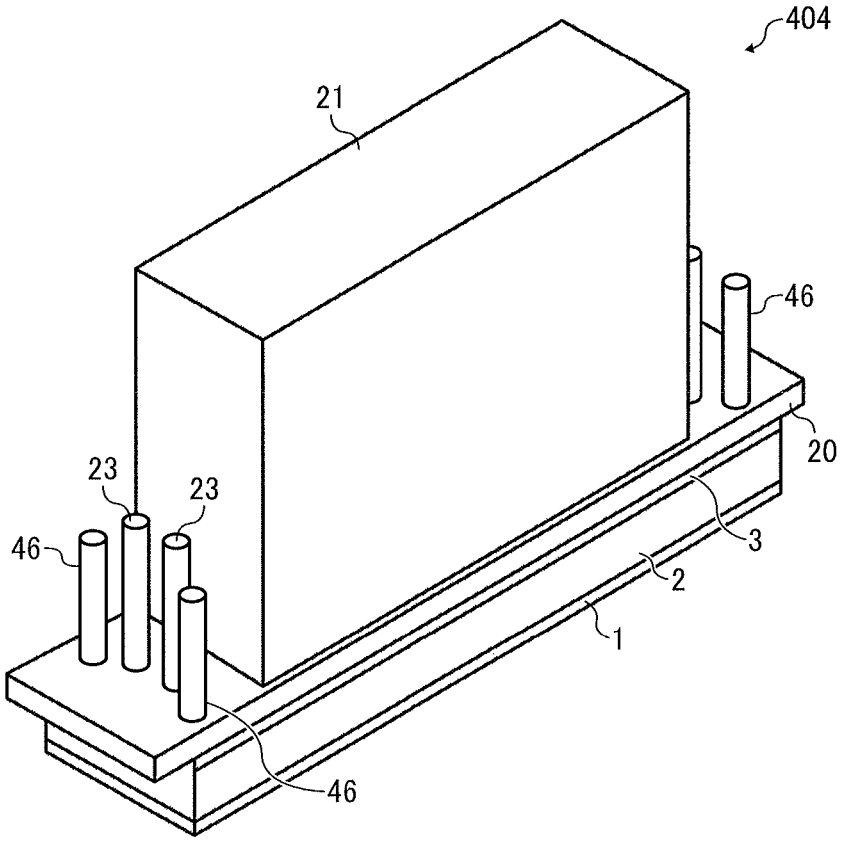
FIG. 1 is an outer perspective view of a liquid discharge head according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Figure 2:
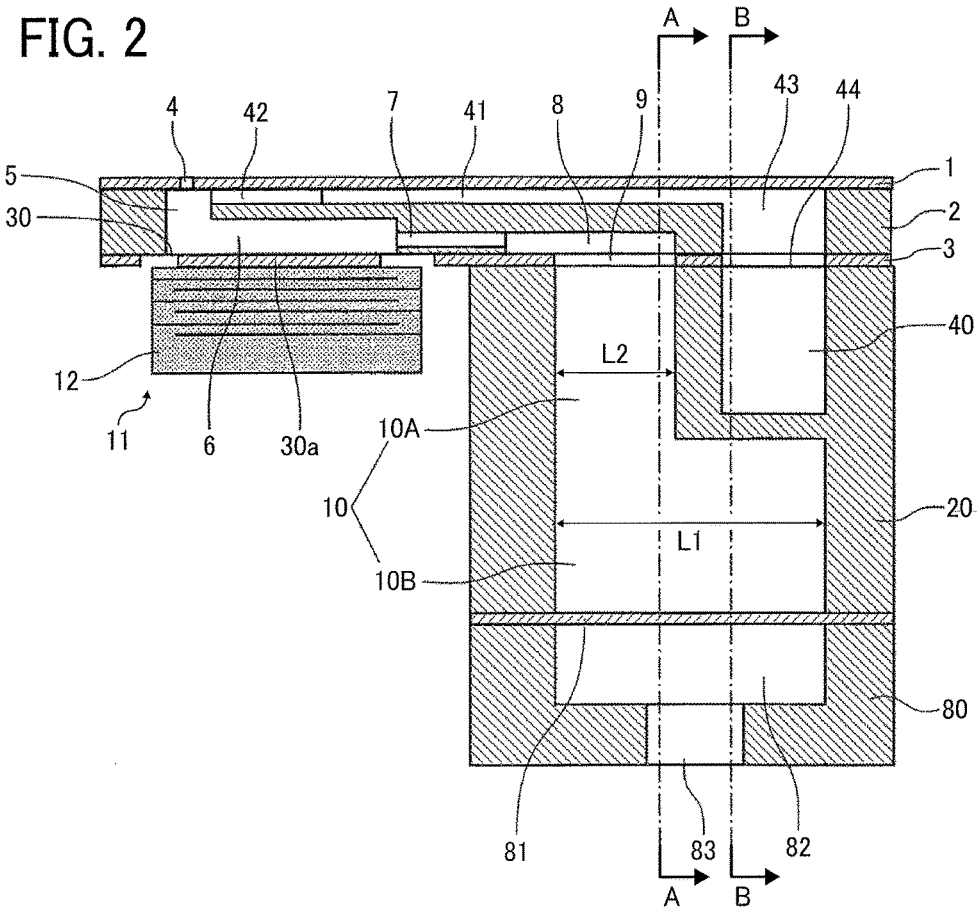
FIG. 2 is a cross-sectional view of the liquid discharge head of FIG. 1 in a direction (a longitudinal direction of an individual liquid chamber) perpendicular to a nozzle array direction in which nozzles are arrayed in row.
Figure 3:
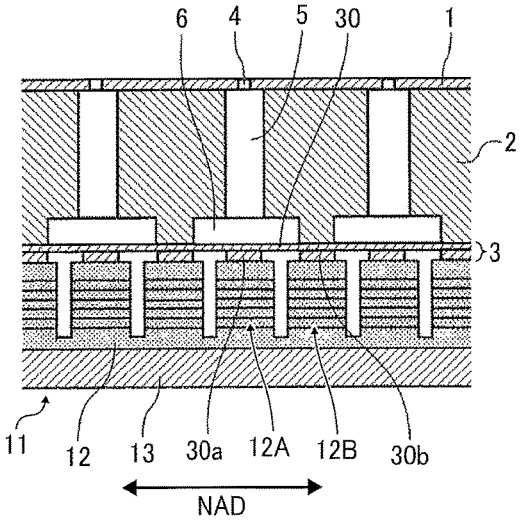
FIG. 3 is a cross-sectional view of the liquid discharge head of FIG. 1 in the nozzle array direction (a transverse direction of the individual liquid chamber)

Below, embodiments of the present disclosure are described with reference to the attached drawings. A liquid discharge head according to a first embodiment of the present disclosure is described with reference to FIGS. 1 to 3. FIG. 1 is an outer perspective view of the liquid discharge head according to the first embodiment. FIG. 2 is a cross-sectional view of the liquid discharge head of FIG. 1 cut in a direction (a longitudinal direction of an individual liquid chamber) perpendicular to a nozzle array direction in which nozzles are arrayed in row. FIG. 3 is a cross-sectional view of the liquid discharge head of FIG. 1 cut in the nozzle array direction (a transverse direction of the individual liquid chamber). Note that liquid is discharged downward in FIG. 1 and upward in FIGS. 2 and 3.

The liquid discharge head 404 according to the fourth embodiment of the present disclosure includes the nozzle plate 1, the channel plate 2, and the diaphragm member 3 as a wall member that are laminated one on another and bonded to each other. The liquid discharge head 404 includes piezoelectric actuators 11 to displace the diaphragm member 3, a common-liquid-chamber substrate 20 as a first frame member, a damper holding substrate 80 as a second frame member, and a cover 21. The common-liquid-chamber substrate 20 and the damper holding substrate 80 constitute the frame members of the liquid discharge head.

The nozzle plate 1 includes a plurality of nozzles 4 to discharge liquid.

The channel plate 2 includes passages 5 communicated with the nozzles 4, individual liquid chambers 6 communicated with the passages 5, fluid restrictors 7 communicated with the individual liquid chambers 6, through-holes and grooves forming liquid introduction portions 8 communicated with the fluid restrictors 7.

The diaphragm member 3 includes openings 9 communicating the liquid introduction portions 8 with a common liquid chamber 10.

The diaphragm member 3 is a wall member forming walls of the individual liquid chambers 6 of the channel plate 2. The diaphragm member 3 has a two-layer structure that includes a first layer including thin portions and facing the channel plate 2 and a second layer that includes thick portions. The first layer includes deformable vibration portions (diaphragms) 30 at positions corresponding to the individual liquid chambers 6. The diaphragm member 3 and the channel plate 2 constitute a channel member.

The piezoelectric actuators 11 including electromechanical transducer elements as driving devices (actuator devices or pressure generators) to deform the vibration portions 30 of the diaphragm member 3 are disposed at a first side of the diaphragm member 3 opposite a second side facing the individual liquid chambers 6.

The piezoelectric actuator 11 includes piezoelectric members 12 bonded on a base 13. The piezoelectric members 12 are groove-processed by half cut dicing so that each piezoelectric member 12 includes a desired number of pillar-shaped piezoelectric elements (piezoelectric pillars) 12A and pillar-shaped piezoelectric elements (piezoelectric pillars) 12B that are arranged in certain intervals to have a comb shape.

In the first embodiment, the piezoelectric elements 12A of the piezoelectric member 12 are piezoelectric elements to be driven by application of drive waveforms and the piezoelectric elements 12B are supports to which no drive waveform is applied. In some embodiments, all of the piezoelectric elements 12A and the piezoelectric elements 12B may be piezoelectric elements to be driven by application of drive waveforms.

The piezoelectric elements 12A are bonded to projections 30*a* being island-shaped thick portions in the vibration portions 30 of the diaphragm member 3. The piezoelectric elements 12B are bonded to projections 30*b* being thick portions of the diaphragm member 3.

The piezoelectric member 12 includes piezoelectric layers and internal electrodes that are alternately laminated. The internal electrodes are led out to end faces of the piezoelectric elements 12A and the piezoelectric elements 12B to form external electrodes.

The common-liquid-chamber substrate 20 is bonded to the diaphragm member 3 to form the common liquid chambers 10 and circulation common liquid chambers 40. The common liquid chamber 10 supplies liquid to the individual liquid chambers 6. Liquid returned from the individual liquid chambers 6 flow into the circulation common liquid chamber 40. In the present embodiment, the circulation common liquid chamber 40 is disposed at a diaphragm member side of the common-liquid-chamber substrate 20 facing the diaphragm member 3.

The channel plate 2 includes circulation channels 41, circulation restrictors 42, and passages 43. The circulation channels 41 are communicated with the respective individual liquid chambers 6 and disposed at a nozzle plate side of the channel plate 2 opposite an individual-liquid-chamber side facing the individual liquid chamber 6. The circulation restrictors 42 are formed by grooves to communicate the circulation channels 41 with the passages 5. The passages 43 are formed by through-holes to communicate the circulation channels 41 with the circulation common liquid chambers 40. The diaphragm member 3 includes openings 44 communicating the passages 43 with the circulation common liquid chambers 40.

As illustrated in FIG. 1, supply ports 23 and circulation ports (delivery ports) 46 are disposed at the outside of the liquid discharge head 404. The supply ports 23 are communicated with the common liquid chambers 10. The circulation ports 46 are communicated with the circulation common liquid chambers 40.

In the liquid discharge head 404 thus configured, for example, when a voltage lower than a reference potential is applied to the piezoelectric element 12A, the piezoelectric element 12A contracts. Accordingly, the vibration portion 30 of the diaphragm member 3 moves downward in FIG. 3 and the volume of the individual liquid chamber 6 increases, thus causing liquid to flow into the individual liquid chamber 6.

When the voltage applied to the piezoelectric element 12A is raised, the piezoelectric element 12A extends in a direction of lamination. Accordingly, the vibration portion 30 of the diaphragm member 3 deforms in a direction toward the nozzle 4 and the volume of the individual liquid chamber 6 reduces. Thus, liquid in the individual liquid chamber 6 is pressurized and discharged from the nozzle 4.

When the voltage applied to the piezoelectric element 12A is returned to the reference potential, the vibration portion 30 of the diaphragm member 3 is returned to the initial position. Accordingly, the individual liquid chamber 6 expands to generate a negative pressure, thus replenishing liquid from the common liquid chamber 10 into the individual liquid chamber 6. After the vibration of a meniscus surface of the nozzle 4 decays to a stable state, the liquid discharge head 404 shifts to an operation for the next droplet discharge.

Note that the driving method of the liquid discharge head is not limited to the above-described example (pull-push discharge). For example, pull discharge or push discharge may be performed in response to the way to apply the drive waveform.

Figure 4:
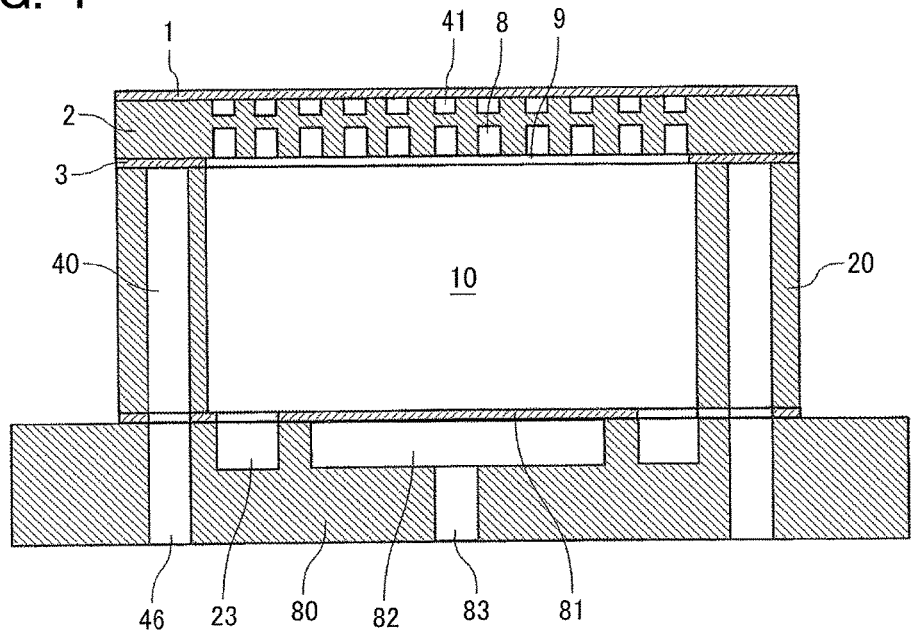
FIG. 4 is a cross-sectional view of the liquid discharge head cut along line A-A of FIG. 2 in the nozzle array direction.
Figure 5:
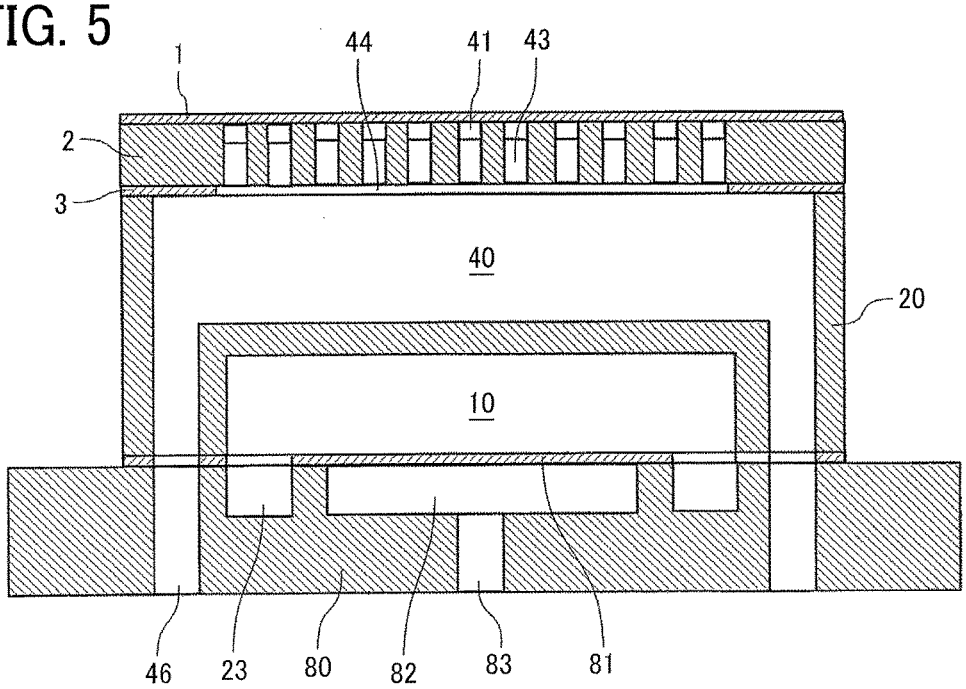
FIG. 5 is a cross-sectional view of the liquid discharge head cut along line B-B in the nozzle array direction.
Figure 6:
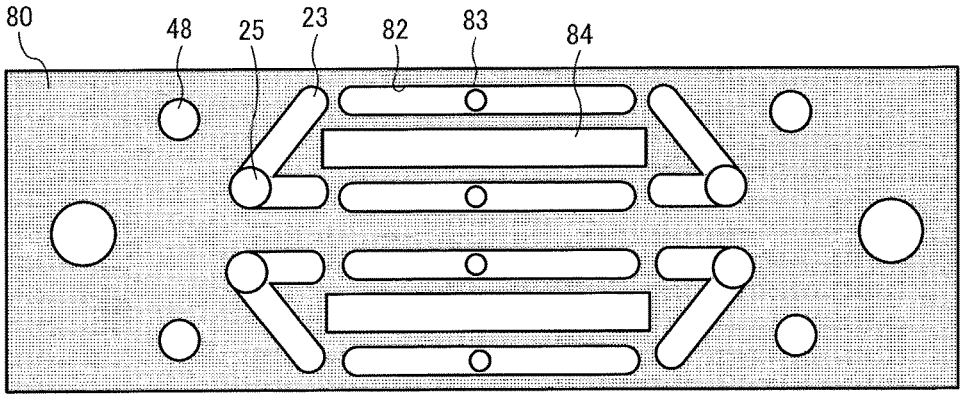
FIG. 6 is a plan view of a damper chamber member.

Next, the configurations of the common liquid chamber, the circulation common liquid chamber, and a damper member according to the first embodiment are described with reference to FIGS. 4 through 6. FIG. 4 is a cross-sectional view of the liquid discharge head cut along line A-A of FIG. 2 in the nozzle array direction. FIG. 5 is a cross-sectional view of the liquid discharge head cut along line B-B in the nozzle array direction. FIG. 6 is a plan view of a damper chamber member.

The common-liquid-chamber substrate 20 is bonded to the diaphragm member 3 to form the common liquid chambers 10 and the circulation common liquid chambers 40. The common liquid chamber 10 supplies liquid to the individual liquid chambers 6. Liquid returned from the individual liquid chambers 6 flow into the circulation common liquid chamber 40. In the present embodiment, the circulation common liquid chamber 40 is disposed at a side of the common-liquid-chamber substrate 20 at which the common liquid chamber 10 is bonded to a channel member (the diaphragm member 3 in the present embodiment).

The circulation common liquid chamber 40 is disposed side by side with a first portion 10A of the common liquid chamber 10 in the in-plane direction of the liquid discharge head 404, to extend in the nozzle array direction indicated by arrow NAD in FIG. 3. The common liquid chamber 10 includes the first portion 10A disposed side by side with the circulation common liquid chamber 40 and a second portion (remaining portion) 10B not disposed side by side with the circulation common liquid chamber 40.

In the first embodiment, when a side of the common liquid chamber 10 communicated with the individual liquid chambers 6 is referred to as a downstream side in a direction of flow of liquid in the liquid discharge head 404, the first portion 10A disposed side by side with the circulation common liquid chamber 40 is a downstream portion and the second portion 10B not disposed side by side with the circulation common liquid chamber 40 is an upstream portion.

As illustrated in FIG. 2, the second portion 10B of the common liquid chamber 10 not disposed side by side with the circulation common liquid chamber 40 has a greater width L1 (hereinafter, simply referred to as "width") in the direction perpendicular to the nozzle array direction NAD than a width L2 of the first portion 10A of the common liquid chamber 10 disposed side by side with the circulation common liquid chamber 40 in the direction perpendicular to the nozzle array direction NAD.

The liquid discharge head 404 includes a damper member 81 as a recoverably-deformable vibration damping member to form a wall surface of the second portion 10B of the common liquid chamber 10 not disposed side by side with the circulation common liquid chamber 40. The damper member 81 is a thin-film member interposed between and held with the common-liquid-chamber substrate 20 and the damper holding substrate 80.

The damper holding substrate 80 includes a damper chamber (atmospheric-air communication chamber) 82 at an opposite side of the common liquid chamber 10 with respect to the damper member 81. The damper chamber 82 is a chamber that allows deformation of the damper member 81. The damper holding substrate 80 further includes an atmospheric-air release communication hole 83 to release the damper chamber 82 to the atmospheric air.

The damper holding substrate 80 includes communication channels 25 and communication channels 26 to communicate the common liquid chambers 10 to the supply ports 23. The damper holding substrate 80 further includes communication channels 48 to communicate the circulation common liquid chambers 40 with the circulation ports 46. Note that the damper member 81 includes ports corresponding to the communication channels 25 and the communication channels 48. The damper member 81 further includes through holes 84 for the piezoelectric actuators 11.

As described above, the circulation common liquid chamber 40 and the first portion 10A of the common liquid chamber 10 are disposed side by side with each other. Such a configuration allows the width of the liquid discharge head to be smaller than a configuration in which the circulation common liquid chamber 40 and the entire of the common liquid chamber 10 are disposed side by side with each other.

In addition, the width L1 of the second portion 10B not disposed side by side with the circulation common liquid chamber 40 is greater than the width L2 of the first portion 10A disposed side by side with the circulation common liquid chamber 40, and the damper member 81 being the vibration damping member is disposed at the wall surface of the second portion 10B. Such a configuration can obtain a relatively large damper area.

Thus, the vibration in the common liquid chamber can be effectively reduced while restricting an increase in size of the liquid discharge head.

Figure 7:
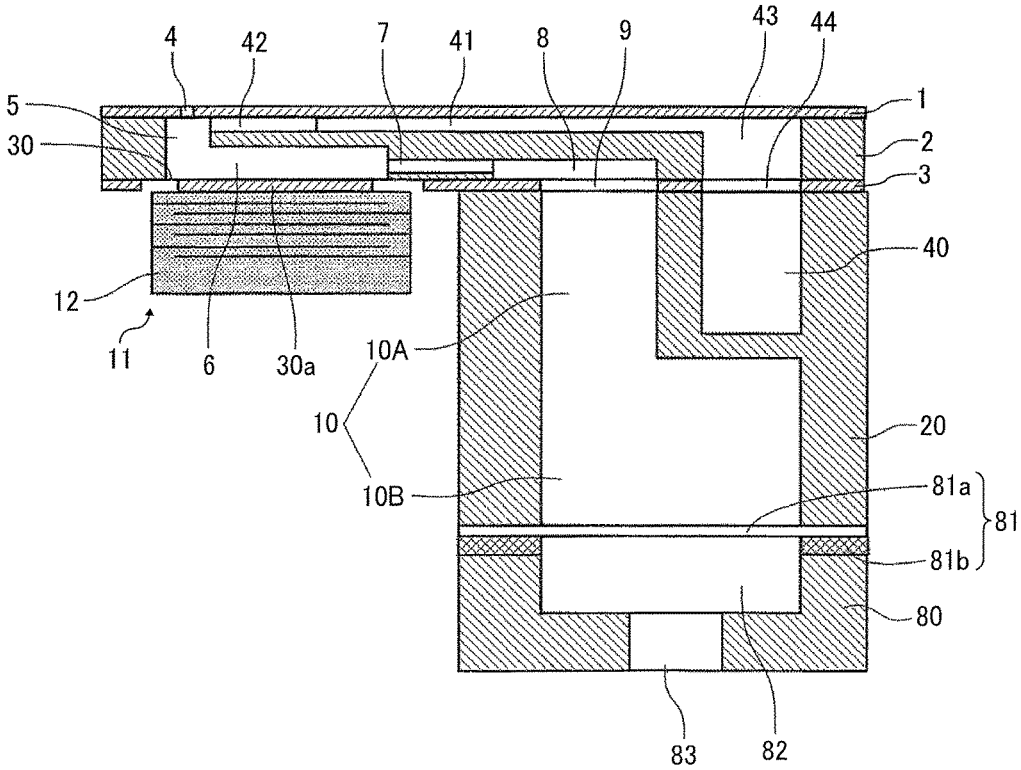
FIG. 7 is a cross-sectional view of the liquid discharge head according to a second embodiment of the present disclosure in the direction perpendicular to the nozzle array direction.

Next, a liquid discharge head according to a second embodiment of the present disclosure is described with reference to FIG. 7. FIG. 7 is a cross-sectional view of the liquid discharge head according to the second embodiment, cut along the direction perpendicular to the nozzle array direction.

In the present embodiment, similarly with the diaphragm member 3, the damper member 81 includes a recoverably-deformable thin portion 81*a* and a thick portion 81*b* on a periphery of the thin portion 81*a*. The thick portion 81*b* of the damper member 81 is interposed between the common-liquid-chamber substrate 20 and the damper holding substrate 80.

Such a configuration enhances usability of the damper member. Both the damper member and the diaphragm member may be Ni electroformed films. In such a case, even when a high-temperature curing adhesive is used, the damper member and the diaphragm member can have substantially the same linear expansion coefficient, thus reducing warpage of component.

Figure 8:
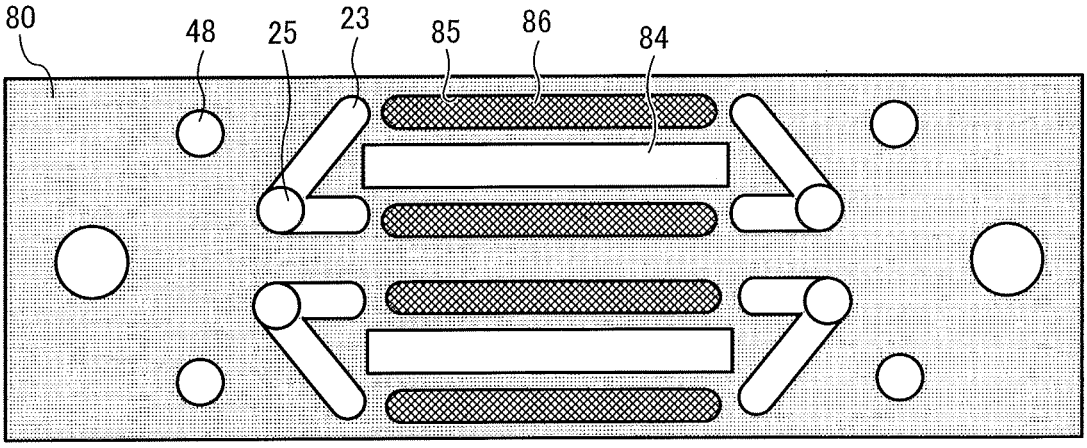
FIG. 8 is a plan view of a damping member holder of the liquid discharge head according to a third embodiment of the present disclosure.

Next, the liquid discharge head according to a third embodiment of the present disclosure is described with reference to FIG. 8. FIG. 8 is a plan view of the damper holding substrate of the liquid discharge head according to the third embodiment.

The damper holding substrate 80 includes elastic-body holding portions 85 facing the common liquid chamber 10. The elastic-body holding portions 85 accommodate elastic bodies 86 forming wall surfaces of the common liquid chambers 10. In such a case, the liquid discharge head does not include the damper member of the above-described first embodiment. However, elastic bodies may filled in the damper chambers 82.

Figure 9:
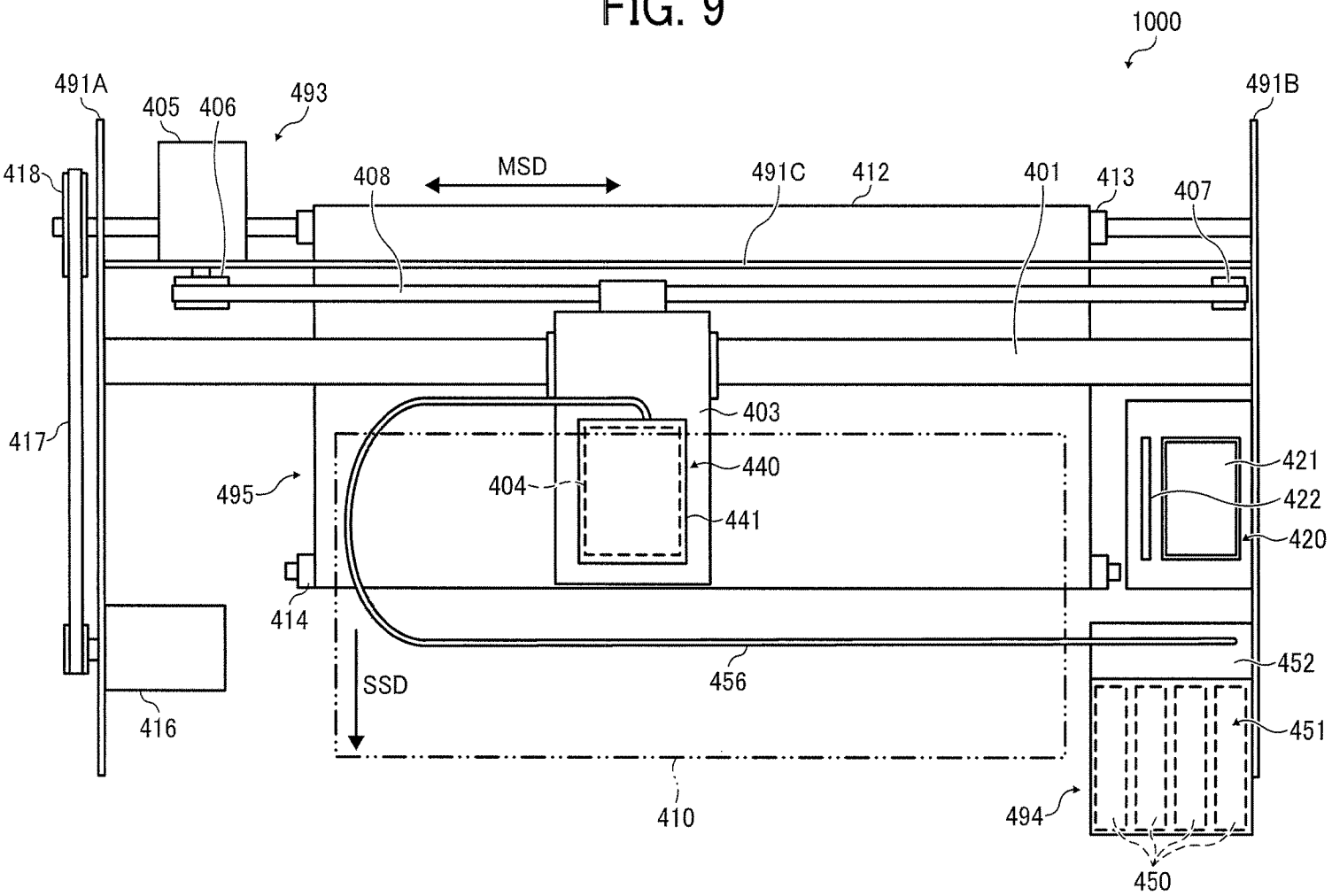
FIG. 9 is a plan view of a portion of a liquid discharge apparatus according to an embodiment of the present disclosure.
Figure 10:
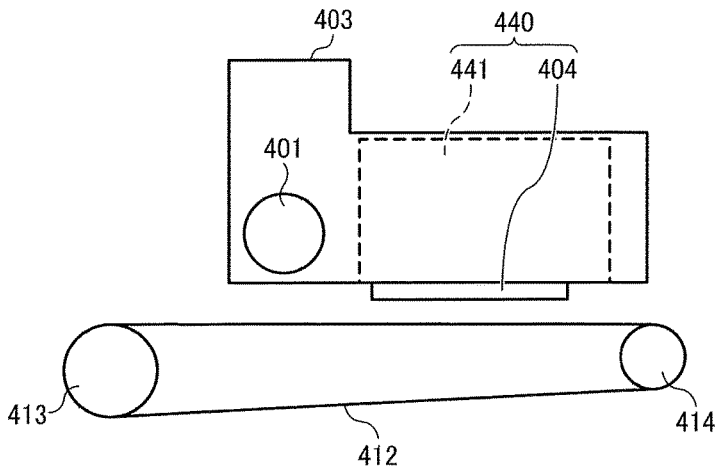
FIG. 10 is a side view of a portion of the liquid discharge apparatus of FIG. 9 including a liquid discharge device according to an embodiment of the present disclosure.

Next, a liquid discharge apparatus according to an embodiment of the present disclosure is described with reference to FIGS. 9 and 10. FIG. 9 is a plan view of a portion of the liquid discharge apparatus according to an embodiment of the present disclosure. FIG. 10 is a side view of a portion of the liquid discharge apparatus of FIG. 9.

A liquid discharge apparatus 1000 according to the present embodiment is a serial-type apparatus in which a main scan moving unit 493 reciprocally moves a carriage 403 in a main scanning direction indicated by arrow MSD in FIG. 9. The main scan moving unit 493 includes, e.g., a guide 401, a main scanning motor 405, and a timing belt 408. The guide 401 is laterally bridged between a left side plate 491A and a right side plate 491B and supports the carriage 403 so that the carriage 403 is movable along the guide 401. The main scanning motor 405 reciprocally moves the carriage 403 in the main scanning direction MSD via the timing belt 408 laterally bridged between a drive pulley 406 and a driven pulley 407.

The carriage 403 mounts a liquid discharge device 440 in which the liquid discharge head 404 and a head tank 441 are integrated as a single unit. The liquid discharge head 404 of the liquid discharge device 440 discharges ink droplets of respective colors of yellow (Y), cyan (C), magenta (M), and black (K). The liquid discharge head 404 includes nozzle rows, each including a plurality of nozzles 4 arrayed in row in a sub-scanning direction, which is indicated by arrow SSD in FIG. 9, perpendicular to the main scanning direction MSD. The liquid discharge head 404 is mounted to the carriage 403 so that ink droplets are discharged downward.

The liquid stored outside the liquid discharge head 404 is supplied to the liquid discharge head 404 via a supply unit 494 that supplies the liquid from a liquid cartridge 450 to the head tank 441.

The supply unit 494 includes, e.g., a cartridge holder 451 as a mount part to mount liquid cartridges 450, a tube 456, and a liquid feed unit 452 including a liquid feed pump. The liquid cartridge 450 is detachably attached to the cartridge holder 451. The liquid is supplied to the head tank 441 by the liquid feed unit 452 via the tube 456 from the liquid cartridges 450.

The liquid discharge apparatus 1000 includes a conveyance unit 495 to convey a sheet 410. The conveyance unit 495 includes a conveyance belt 412 as a conveyor and a sub-scanning motor 416 to drive the conveyance belt 412.

The conveyance belt 412 electrostatically attracts the sheet 410 and conveys the sheet 410 at a position facing the liquid discharge head 404. The conveyance belt 412 is an endless belt and is stretched between a conveyance roller 413 and a tension roller 414. The sheet 410 is attracted to the conveyance belt 412 by electrostatic force or air aspiration.

The conveyance roller 413 is driven and rotated by the sub-scanning motor 416 via a timing belt 417 and a timing pulley 418, so that the conveyance belt 412 circulates in the sub-scanning direction SSD.

At one side in the main scanning direction MSD of the carriage 403, a maintenance unit 420 to maintain and recover the liquid discharge head 404 in good condition is disposed on a lateral side of the conveyance belt 412.

The maintenance unit 420 includes, for example, a cap 421 to cap a nozzle face (i.e., a face on which the nozzles are formed) of the liquid discharge head 404 and a wiper 422 to wipe the nozzle face.

The main scan moving unit 493, the supply unit 494, the maintenance unit 420, and the conveyance unit 495 are mounted to a housing that includes the left side plate 491A, the right side plate 491B, and a rear side plate 491C.

In the liquid discharge apparatus 1000 thus configured, the sheet 410 is conveyed on and attracted to the conveyance belt 412 and is conveyed in the sub-scanning direction SSD by the cyclic rotation of the conveyance belt 412.

The liquid discharge head 404 is driven in response to image signals while the carriage 403 moves in the main scanning direction MSD, to discharge liquid to the sheet 410 stopped, thus forming an image on the sheet 410.

As described above, the liquid discharge apparatus 1000 includes the liquid discharge head 404 according to an embodiment of the present disclosure, thus allowing stable formation of high quality images.

Figure 11:
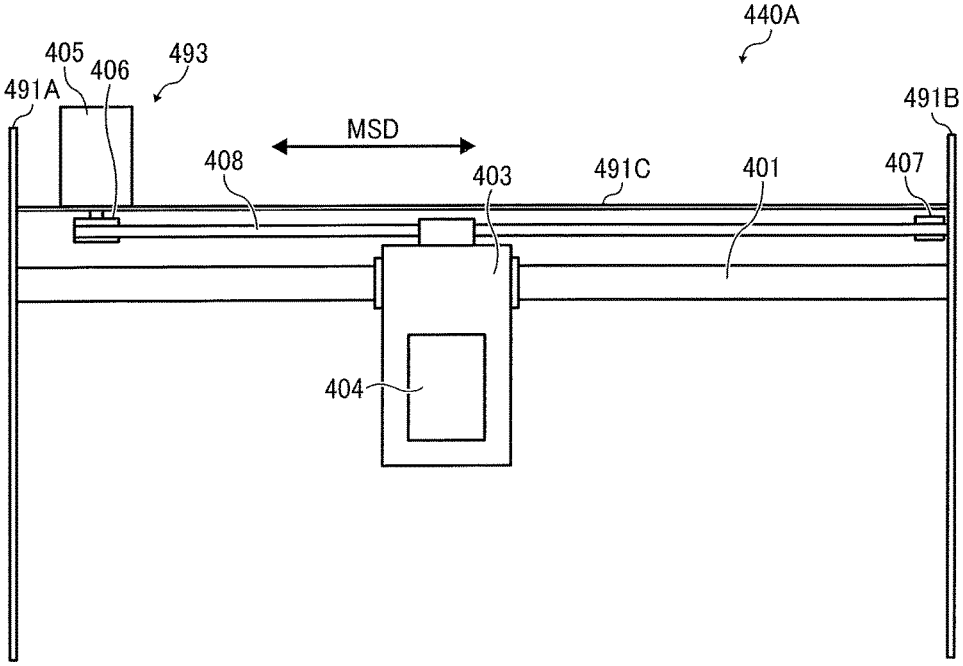
FIG. 11 is a plan view of a portion of the liquid discharge device according to another embodiment of the present disclosure.

Next, another example of the liquid discharge device according to an embodiment of the present disclosure is described with reference to FIG. 11. FIG. 11 is a plan view of a portion of another example of the liquid discharge device (liquid discharge device 440A).

The liquid discharge device 440A includes the housing, the main scan moving unit 493, the carriage 403, and the liquid discharge head 404 among components of the liquid discharge apparatus 1000. The left side plate 491A, the right side plate 491B, and the rear side plate 491C constitute the housing.

Note that, in the liquid discharge device 440A, at least one of the maintenance unit 420 and the supply unit 494 may be mounted on, for example, the right side plate 491B.

Figure 12:
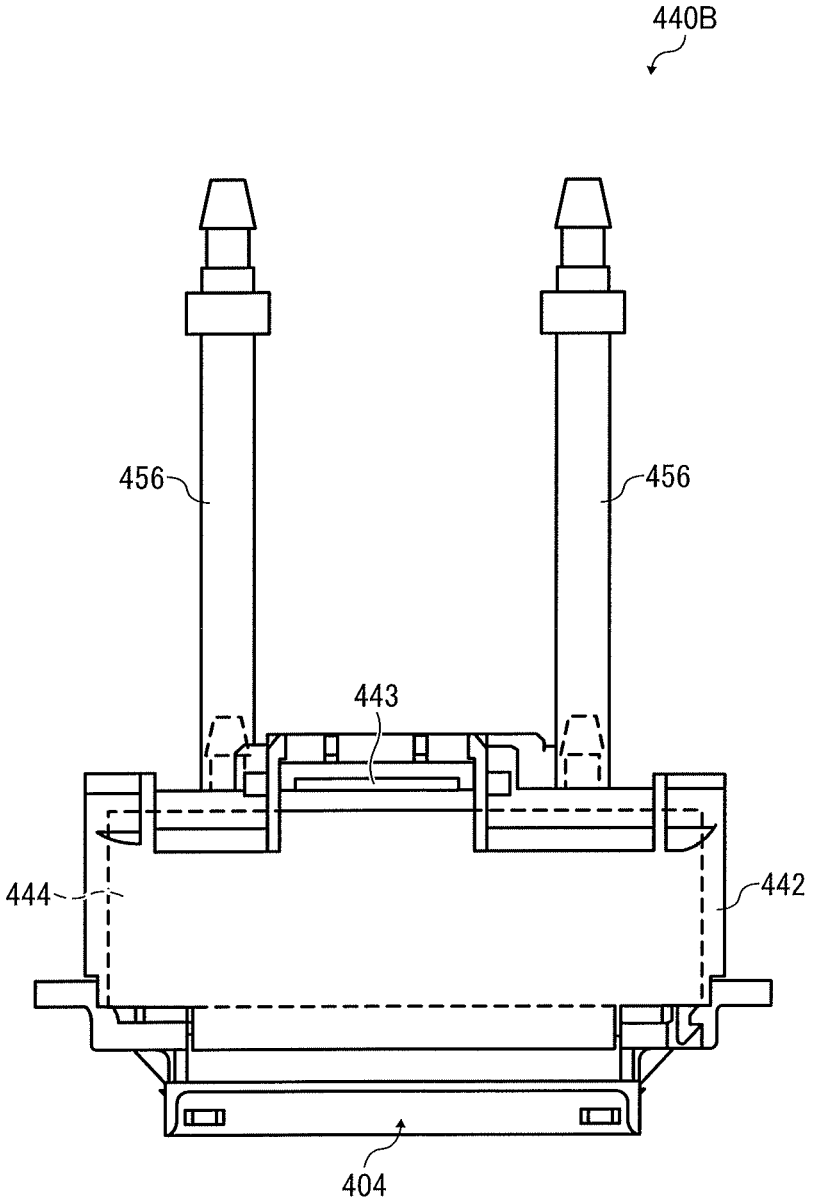
FIG. 12 is a front view of the liquid discharge device according to still another embodiment of the present disclosure.

Next, still another example of the liquid discharge device according to an embodiment of the present disclosure is described with reference to FIG. 12. FIG. 12 is a front view of still another example of the liquid discharge device (liquid discharge device 440B).

The liquid discharge device 440B includes the liquid discharge head 404 to which a channel part 444 is mounted, and the tube 456 connected to the channel part 444.

Further, the channel part 444 is disposed inside a cover 442. Instead of the channel part 444, the liquid discharge device 440B may include the head tank 441. A connector 443 to electrically connect the liquid discharge head 404 to a power source is disposed above the channel part 444.

In the present disclosure, discharged liquid is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling. Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a thermal resistor, and an electrostatic actuator including a diaphragm and opposed electrodes.

The liquid discharge device is an integrated unit including the liquid discharge head and a functional part(s) or unit(s), and is an assembly of parts relating to liquid discharge. For example, the liquid discharge device may be a combination of the liquid discharge head with at least one of the head tank, the carriage, the supply unit, the maintenance unit, and the main scan moving unit.

Here, examples of the integrated unit include a combination in which the liquid discharge head and a functional part(s) are secured to each other through, e.g., fastening, bonding, or engaging, and a combination in which one of the liquid discharge head and a functional part(s) is movably held by another. The liquid discharge head may be detachably attached to the functional part(s) or unit(s) s each other.

For example, the liquid discharge head and a head tank are integrated as the liquid discharge device. The liquid discharge head and the head tank may be connected each other via, e.g., a tube to integrally form the liquid discharge device. Here, a unit including a filter may further be added to a portion between the head tank and the liquid discharge head.

In another example, the liquid discharge device may be an integrated unit in which a liquid discharge head is integrated with a carriage.

In still another example, the liquid discharge device may be the liquid discharge head movably held by a guide that forms part of a main-scanning moving device, so that the liquid discharge head and the main-scanning moving device are integrated as a single unit. The liquid discharge device may include the liquid discharge head, the carriage, and the main scan moving unit that are integrated as a single unit.

In another example, the cap that forms part of the maintenance unit is secured to the carriage mounting the liquid discharge head so that the liquid discharge head, the carriage, and the maintenance unit are integrated as a single unit to form the liquid discharge device.

Further, in another example, the liquid discharge device includes tubes connected to the head tank or the channel member mounted on the liquid discharge head so that the liquid discharge head and the supply assembly are integrated as a single unit. Liquid is supplied from a liquid reservoir source to the liquid discharge head.

The main-scan moving unit may be a guide only. The supply unit may be a tube(s) only or a loading unit only.

The term "liquid discharge apparatus" used herein also represents an apparatus including the liquid discharge head or the liquid discharge device to discharge liquid by driving the liquid discharge head. The liquid discharge apparatus may be, for example, an apparatus capable of discharging liquid to a material to which liquid can adhere or an apparatus to discharge liquid toward gas or into liquid.

The liquid discharge apparatus may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The liquid discharge apparatus may be, for example, an image forming apparatus to form an image on a sheet by discharging ink, or a three-dimensional apparatus to discharge a molding liquid to a powder layer in which powder material is formed in layers, so as to form a three-dimensional article.

The liquid discharge apparatus is not limited to an apparatus to discharge liquid to visualize meaningful images, such as letters or figures. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited.

Examples of the material on which liquid can be adhered include any materials on which liquid can be adhered even temporarily, such as paper, thread, fiber, fabric, leather, metal, plastic, glass, wood, and ceramic.

The liquid discharge apparatus may be an apparatus to relatively move a liquid discharge head and a material on which liquid can be adhered. However, the liquid discharge apparatus is not limited to such an apparatus. For example, the liquid discharge apparatus may be a serial head apparatus that moves the liquid discharge head or a line head apparatus that does not move the liquid discharge head.

Examples of the liquid discharge apparatus further include a treatment liquid coating apparatus to discharge a treatment liquid to a sheet to coat the treatment liquid on the surface of the sheet to reform the sheet surface and an injection granulation apparatus in which a composition liquid including raw materials dispersed in a solution is injected through nozzles to granulate fine particles of the raw materials.

The terms "image formation", "recording", "printing", "image printing", and "molding" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:
- a plurality of nozzles to discharge liquid;
- a plurality of individual liquid chambers communicated with the plurality of nozzles;
- a circulation channel communicated with the plurality of individual liquid chambers;
- a circulation common liquid chamber communicated with the circulation channel;
- a common liquid chamber to supply the liquid to the plurality of individual liquid chambers,
- the common liquid chamber including:
  - a first portion disposed side by side with the circulation common liquid chamber in an in-plane direction; and
  - a second portion having a width greater than a width of the first portion in the in-plane direction; and
- a vibration damping member being recoverably deformable and constituting a wall surface of the second portion of the common liquid chamber.

2. The liquid discharge head according to claim 1, wherein the vibration damping member is a thin-film member.

3. The liquid discharge head according to claim 2, wherein the thin-film member includes a recoverably-deformable thin portion and a thick portion on a periphery of the thin portion.

4. The liquid discharge head according to claim 2, further comprising:
- a chamber disposed at a side opposite the common liquid chamber with respect to the thin-film member, to allow deformation of the thin-film member.

5. The liquid discharge head according to claim 1, wherein the vibration damping member is an elastic body.

6. A liquid discharge device comprising:
- the liquid discharge head according to claim 1, to discharge liquid.

7. The liquid discharge device according to claim 6, wherein the liquid discharge head is integrated as a single unit with at least one of:
- a head tank to store the liquid to be supplied to the liquid discharge head;
- a carriage mounting the liquid discharge head;
- a supply unit to supply the liquid to the liquid discharge head;
- a maintenance unit to maintain and recover the liquid discharge head; and a main scan moving unit to move the liquid discharge head in a main scanning direction.

8. A liquid discharge apparatus comprising:

the liquid discharge device according to claim 6, to discharge the liquid.

9. A liquid discharge apparatus comprising:

the liquid discharge head according to claim 1, to discharge the liquid.

10. The liquid discharge head according to claim 1, wherein the liquid flows in a liquid flow direction from the common liquid chamber to the plurality of nozzles via the plurality of respective individual liquid chambers, and wherein the liquid discharge head further comprises a plurality of fluid restrictors communicated with the plurality of respective individual liquid chambers, and the common liquid chamber is upstream, in the liquid flow direction, of the plurality of respective fluid restrictors.

11. The liquid discharge head according to claim 1, wherein the liquid flows in a liquid flow direction from the common liquid chamber to the plurality of nozzles via the plurality of respective individual liquid chambers, and the common liquid chamber is upstream, in the liquid flow direction, of the plurality of respective individual liquid chambers.

12. The liquid discharge head according to claim 1, wherein the first portion of the common liquid chamber is a single chamber portion feeding the liquid to the plurality of individual liquid chambers, and the second portion of the common liquid chamber is a single chamber portion communicating with the plurality of individual liquid chambers.

13. A liquid discharge head comprising:

plural nozzles to discharge liquid;

plural individual liquid chambers communicated with the plural nozzles, respectively;

a circulation channel communicated with the plural individual liquid chambers;

a circulation common liquid chamber communicated with the circulation channel;

a common liquid chamber to supply the liquid to the plural individual liquid chambers, the common liquid chamber including:

a first portion disposed side by side with the circulation common liquid chamber in an in-plane direction, to feed the liquid to the plural individual liquid chambers; and a second portion having a width greater than a width of the first portion in the in-plane direction.

14. A liquid discharge apparatus comprising:

the liquid discharge head according to claim 13, to discharge the liquid; and a head tank to store the liquid to be supplied to the liquid discharge head.

15. A liquid discharge apparatus comprising:

the liquid discharge head according to claim 13, to discharge the liquid; and a carriage mounting the liquid discharge head.

* * * * *